United States Patent [19]

Pikul

[11] Patent Number: 4,868,534

[45] Date of Patent: Sep. 19, 1989

[54] COIL ASSEMBLY WITH FIXEDLY LOCATED WIRE CONNECTORS

[75] Inventor: Henry Pikul, Chicago, Ill.

[73] Assignee: North American Philips Corporation, New York, N.Y.

[21] Appl. No.: 326,595

[22] Filed: Mar. 21, 1989

[51] Int. Cl.[4] ..... H01F 15/10

[52] U.S. Cl. ..... 336/192

[58] Field of Search ..... 336/192; 310/71, 234; 439/863

[56] References Cited

U.S. PATENT DOCUMENTS 4,166,265 8/1979 Reynolds et al. ..... 336/192

*Primary Examiner*—Thomas J. Kozma

*Attorney, Agent, or Firm*—Robert T. Mayer

[57] ABSTRACT

A coil assembly including an adaptor for receiving wire connectors for the end wires of appliance coils whereby the wire connectors are secured and located in a uniform manner.

9 Claims, 1 Drawing Sheet

FIG. 1
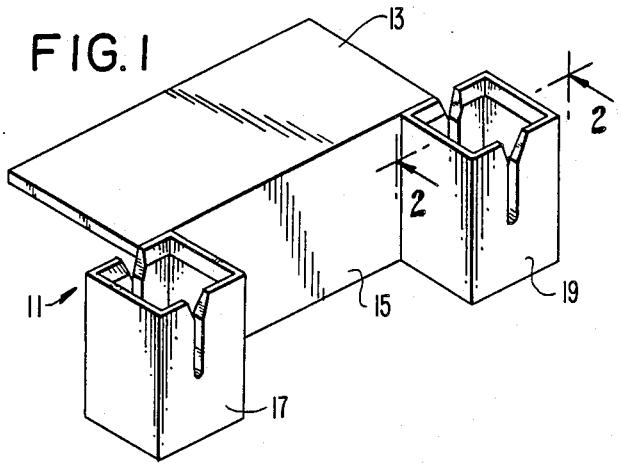
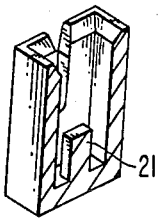
FIG. 2
FIG. 3
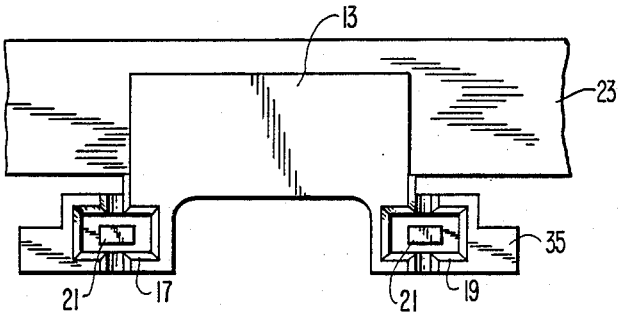
FIG. 4
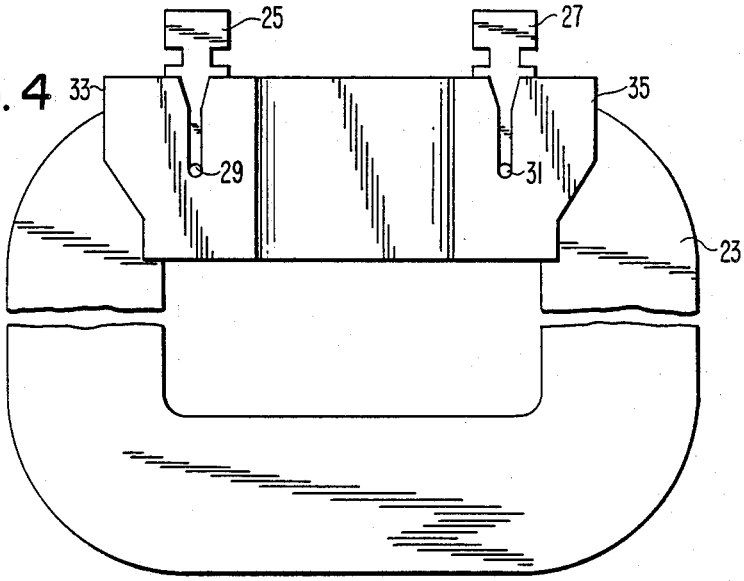

COIL ASSEMBLY WITH FIXEDLY LOCATED WIRE CONNECTORS

This is an invention in the electrical art. More particularly, it involves coil assemblies for use, for example, in microwave ovens. Each assembly includes a coil and an adaptor laving two receptacles, each of which can hold a wire connector. Each wire connector while in its receptacle engages in electrical contact one of the end wires of the coil.

In the past the end wires of electrical coils have been terminated by clamping an electrical connector on each of the two end wires of a coil. A portion of each of these clamped connectors was then wrapped in a fiber material which was then impregnated with silica-filled polyester resin. Heating, cured the resin and hardened the fiber around the connector.

With the above-mentioned terminating arrangement the electrical connectors on coils were not secured sufficiently with respect to the coil and sometimes ended up located improperly. Consequently they would not fit into the electrical receptacles provided for them on the appliance in which the coil was to be used. Improperly located wire connectors have resulted in rejects at appliance manufacturers' factories.

In addition, since the connectors were not sufficiently secured, manual handling after heat setting of the silica: resin was required which could result in the wire connectors breaking away from the ends of coils.

Even after a coil was located in its associated appliance and the wire connectors were oriented properly in their electrical receptacle, it was not unheard of to have a failure of the appliance take place as a result of the failure of the structure of the wire connector.

It is an object of this invention to provide an adaptor for a coil assembly which provides a locating device for locating wire connectors properly with respect to their associated coil and for securing them thereto.

One of the features of the invention is that the adaptor is easy to assemble with a coil.

Another feature of the invention is that the adaptor provides support for its associated coil.

One of the advantages of the invention is that the adaptor is inexpensive. Another advantage is that the adaptor is universal for a range of wire sizes. A further advantage is that the same size adaptor can be used with coils of varying thickness and width.

Another advantage of the invention is that it reduces manual handling and increases automated manufacturing.

Another advantage of the invention is that the adaptor can be oriented to provide receptacles for wire connectors that are perpendicular to the coil axis or parallel to it.

In accordance with the invention there is provided a coil assembly including a wire coil with at least two terminating leads. The wire coil is a substantially square shaped toroid with four legs each having four substantially flat sides. An adaptor comprising an L-shaped bracket with flat interior surfaces on the legs of the L is also included in the assembly. The flat interior surfaces of the adaptor adjoin two of the three outer sides of one of the legs of the toroid. Two receptacles are attached to the outer surface of one of the legs of the L-shaped bracket. Two wire connectors are also included in the assembly. The receptacles have cavities and each holds one of the wire connectors in its cavity. Each wire connector engages in electrical contact one or more of the terminating leads of the coil.

Other objects, features and advantages of the invention will be apparent from the following description and appended claims when considered in conjunction with the accompanying drawing in which:

FIG. 1 is a perspective view of one embodiment of an adaptor useful in practicing the invention disclosed herein;

FIG. 2 is a section through a receptacle of the adaptor of FIG. 1;

FIG. 3 is a plan view of a preferred embodiment of an adaptor of the invention illustrated with a portion of a coil with which it is intended to be assembled; and FIG. 4 is a front view of the adaptor and coil of FIG. 3 with wire connectors shown in the adaptor receptacles.

The drawing is not to scale and is for illustrative purposes only. Referring to FIG. 1 there is shown adaptor 11 which comprises an L-shaped bracket having legs 13 and 15. Extending from each end of leg 15 are receptacles 17 and 19. Each of the receptacles is slotted to receive one of the terminating lead wires of an associated coil. A terminating lead wire may be an end wire or a tapped wire.

As can be seen from FIG. 2 an anvil 21 is provided at the bottom of each of receptacles 17 and 19 to serve to support its associated terminating lead wire when a wire connector is inserted in the associated receptacle.

FIG. 3 shows the preferred embodiment of adaptor 11 resting on the upper surface of coil 23 which is shown in part. As can be seen from FIGS. 3 and 4 the coil (shown in segment in FIG. 4) would be substantially a rectangularly shaped toroid, each leg of which would have four substantially flat sides. The flat interior surfaces of legs 13 and 15 in assembly adjoin two of the three outer sides of one of the legs of the toroid. When known wire connectors 25 and 27 comprising two tined sections (sold under the name Mag-Mate terminals by AMP Inc., Harrisburg, PA.) are pushed into receptacles 17 and 19 respectively, they engage terminating leads 29 and 31 of coil 23 for electrical connection thereto.

In the preferred embodiment adaptor 11 is secured to coil 23 by having tape (not shown) wrapped around its legs 13 and 15 as well as the adjoining leg of coil 23. It is to be understood that adaptor 11 can be brought into such engagement with coil 23 by machine. A machine can also wrap the tape around the adaptor and the coil and connectors 25 and 27 can be inserted in receptacles 17 and 19 also by machine.

As can be seen the preferred adaptor has wings 33 and 35. Since adaptor 11 is molded plastic, wings 33 and 35 make it easier to remove the adaptor from its mold.

From the foregoing it can be seen that adaptor 11 provides a locating and securing device for wire connectors 25 and 27. It should be appreciated that because connectors 25 and 27 are fixedly located on the coil assembly an appliance manufacturer can automate his manufacturing process for fitting coil assemblies made in accordance with the invention into his appliances.

It is to be understood that adaptor 11 is universal for a range of wire sizes. Moreover, the same size adaptor can be used with coils of varying thickness t and width w of legs 13 and 15. While adaptor 11 in FIG. 4 has been oriented to have terminals 25 and 27 in a plane perpendicular to the central axis a of coil 23, it is to be appreciated that by rotating adaptor 11 ninety degrees terminals 25 and 27 can be located in a plane parallel to axis a of coil 23. It is also to be understood that whereas legs 13 and 15 are shown to be solid, it is contemplated that either or both could be slotted without avoiding the disclosed invention.

It should be apparent that various modifications of the above will be evident to those skilled in the art and that the arrangement described herein is for illustrative purposes and is not to be considered restrictive.

What is claimed is:

1. A coil assembly including a wire coil with at least two terminating leads, said wire coil being a substantially rectangularly shaped toroid with four legs at least one of said legs having two substantially flat sides, an adaptor including an L-shaped bracket with flat interior surfaces on the legs of the L, said flat interior surfaces adjoining said two substantially flat sides of said at least one leg of said toroid, two receptacles attached to the outer surface at each end of one of the legs of said L-shaped bracket, said receptacles having cavities, and two wire connectors, one of said wire connectors being held in each of said cavities, each wire connector engaging in electrical contact one or more of the terminating leads of said coil.

2. A coil assembly as claimed in claim 1, wherein said adaptor is secured to said coil by being taped thereto.

3. A coil assembly as claimed in claim 2, wherein the wire connectors are oriented to lie in a plane perpendicular to the axis of said coil.

4. A coil assembly as claimed in claim 2, wherein the wire connectors are oriented to lie in a plane parallel to the axis of said coil.

5. A coil assembly as claimed in claim 3 or claim 4, wherein said receptacles have wings extending away from the ends of the leg of said L-shaped bracket to which said receptacles are attached.

6. A coil assembly as claimed in claim 5, wherein each of said receptacles is slotted for receiving its associated end wire of said coil.

7. A coil assembly as claimed in claim 6, wherein each of said receptacles includes an element raised from its bottom for supporting its associated end wire when its associated wire connector is inserted for electrical engagement with said end wire.

8. A coil assembly as claimed in claim 5, wherein each of said legs of said coil has at least two substantially flat sides.

9. A coil assembly as claimed in claim 8, wherein each of said leg has four substantially flat sides.

* * * * *